US010295936B2

(12) United States Patent
Sato

(10) Patent No.: US 10,295,936 B2
(45) Date of Patent: May 21, 2019

(54) FIXING DEVICE

(71) Applicant: CANON KABUSHIKI KAISHA, Tokyo (JP)

(72) Inventor: Noriaki Sato, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/659,019

(22) Filed: Jul. 25, 2017

(65) Prior Publication Data

US 2018/0032005 A1 Feb. 1, 2018

(30) Foreign Application Priority Data

Jul. 28, 2016 (JP) ..... 2016-148698

(51) Int. Cl.
*G03G 15/20* (2006.01)

(52) U.S. Cl.
CPC ..... *G03G 15/2007* (2013.01); *G03G 15/20* (2013.01); *G03G 15/2053* (2013.01); *G03G 2215/2035* (2013.01)

(58) Field of Classification Search
CPC ..... G03G 15/20; G03G 15/2007; G03G 2215/2035
See application file for complete search history.

(56) References Cited

U.S. PATENT DOCUMENTS

2012/0051809 A1* 3/2012 Miyauchi ..... G03G 15/2064 399/329
2012/0177420 A1* 7/2012 Shimokawa ..... G03G 15/2017 399/329

FOREIGN PATENT DOCUMENTS

| | | | |
|---|---|---|---|
| JP | 2001-185328 | A | 7/2001 |
| JP | 2007-114524 | A | 5/2007 |
| JP | 2009-244400 | A | 10/2009 |
| JP | 2013-114057 | A | 6/2013 |
| JP | 2014-071212 | A | 4/2014 |

* cited by examiner

*Primary Examiner* — Ryan D Walsh
(74) *Attorney, Agent, or Firm* — Canon U.S.A., Inc. IP Division

(57) ABSTRACT

A fixing device includes a cylindrical film, a sliding plate contacting an inner surface of the film, the sliding plate, and a roller forming a nip portion with the sliding plate via the film, the roller including an elastic layer, and extending in a longitudinal direction of the film. The film and the sliding plate have respective longitudinal end portions positioned on an outer side of a longitudinal end portion of the elastic layer. The sliding plate includes a curvature portion curved along a circumferential direction of an inner surface of the film on an upstream side of the nip portion in a recording medium conveyance direction, and the curvature portion includes a recessed region in which a longitudinal end portion of the curvature portion is recessed from the inner surface of the film relative to a longitudinal middle portion of the curvature portion.

27 Claims, 9 Drawing Sheets

FIXING DEVICE

BACKGROUND OF THE INVENTION

Field of the Invention

The disclosure relates to a fixing device to be used in an electrophotographic image forming apparatus, such as a copying machine, a laser beam printer, and a facsimile.

Description of the Related Art

A fixing device with a film having a low heat capacity is known as a fixing device to be disposed in an electrophotographic image forming apparatus. Such a fixing device includes a cylindrical film, a sliding plate that slides while in contact with an inner surface of the film, a heater that heats the sliding plate with radiation heat, and a roller that nips the film with the sliding plate to form a nip portion, as discussed in Japanese Patent Application Laid-Open No. 2013-114057. In the nip portion, the fixing device heats a recording medium bearing an image while conveying the recording medium to fix the image on the recording medium. Thus, this fixing device has features of a short warm-up time and low energy consumption.

Japanese Patent Application Laid-Open No. 2013-114057 discusses a sliding plate of a fixing device. The sliding plate has a curvature portion that is curved along an inner surface of a film on an upstream side of a nip portion in a recording medium conveyance direction. The curvature portion can preheat the film before the film enters the nip portion. Thus, the curvature portion has a merit that the film can be effectively heated.

However, since a longitudinal end portion of the film extending to an outer side of a longitudinal end portion of a roller is not retained in the nip portion, an inner side of the film strongly slides against the curvature portion of the sliding plate. The inner side of the film is thus liable to be abraded.

SUMMARY OF THE INVENTION

According to an aspect of the disclosure, A fixing device for fixing an image on a recording medium, the fixing device includes a cylindrical film, a sliding plate that contacts an inner surface of the film, the sliding plate extending in a longitudinal direction of the film, and a roller that forms a nip portion with the sliding plate via the film, the roller including a metal core and an elastic layer formed outside the metal core, and extending in a longitudinal direction of the film. In the nip portion, the recording medium on which the image is formed is heated while the recording medium is being conveyed, and the image is fixed on the recording medium. The film and the sliding plate have respective longitudinal end portions positioned on an outer side of a longitudinal end portion of the elastic layer of the roller. The sliding plate includes a curvature portion that is curved along a circumferential direction of an inner surface of the film on an upstream side of the nip portion in a recording medium conveyance direction and extends along a longitudinal direction of the sliding plate, and the curvature portion includes a recessed region in which a longitudinal end portion of the curvature portion is recessed from the inner surface of the film relative to a longitudinal middle portion of the curvature portion. In the longitudinal direction of the film, the recessed region is provided in a region of the curvature portion at least on an outer side of a position corresponding to the longitudinal end portion of the elastic layer and on an inner side of a position corresponding to the longitudinal end portion of the film in the curvature portion.

Further features of the disclosure will become apparent from the following description of example embodiments with reference to the attached drawings.

DESCRIPTION OF THE EXAMPLE EMBODIMENTS

A first example embodiment of the disclosure is hereinafter described with reference to the drawings. First, a schematic configuration of an image forming apparatus is described. Secondly, a schematic configuration of a fixing device is described.

[Schematic Configuration of Image Forming Apparatus]

Figure 1:
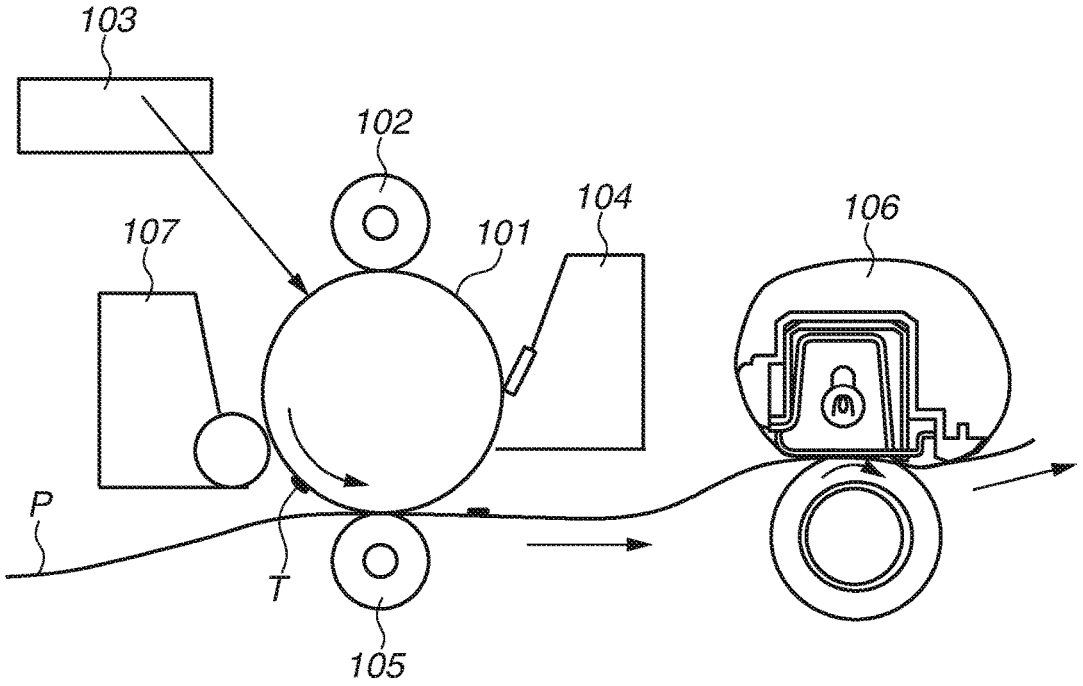
FIG. 1 is a schematic configuration diagram illustrating an image forming apparatus according to a first example embodiment.

FIG. 1 illustrates a schematic configuration of the image forming apparatus. A photoconductor drum 101 is driven to rotate in a direction (counterclockwise) indicated by an arrow illustrated in FIG. 1 at a predetermined circumferential velocity, and the surface of the photoconductor drum 101 is uniformly charged with a predetermined polarity by a charging roller 102 serving as a charging member. Subsequently, a scanning exposure unit 103 emits a laser beam modulated according to image information to the uniformly charged surface of the photoconductor drum 101, forming an electrostatic latent image on the surface of the photoconductor drum 101.

A developing device 107 develops and visualizes the electrostatic latent image as a toner image T. A transfer roller 105 to which a voltage is applied transfers the visualized toner image T to a recording medium P conveyed to time with the toner image T by a sheet feeding mechanism (not illustrated).

The recording medium P with the transferred toner image T is separated from the photoconductor drum 101 and then conveyed to a fixing device 106. The fixing device 106 fixes the toner image on the recording medium P with heat and pressure. The recording medium P with the fixed toner image is discharged outside the image forming apparatus.

Meanwhile, a residual toner that is not transferred to the recording medium P remains on the surface of the photoconductor drum 101 after the recoding medium P is separated from the photoconductor drum 101. A cleaning device 104 removes such a residual toner from the photoconductor drum 101, so that image formation can be repeatedly performed.

[Schematic Configuration of Fixing Device]

A configuration of the fixing device 106 according to the present example embodiment is described with reference to FIG. 2, which illustrates a schematic sectional view perpendicular to a longitudinal direction of a film 201 in a longitudinal middle portion of the fixing device 106.

The fixing device 106 includes the cylindrical film 201, a sliding plate 213, a heater 207, and a pressure roller 203. The sliding plate 213 slides in contact with an inner surface of the film 201, and the heater 207 heats the sliding plate 213. The pressure roller 203 nips the film 201 with the sliding plate 213, and forms a nip portion N with the sliding plate 213. The film 201 is heated by heat transferred from the sliding plate 213. In the nip portion N, the toner image T is fixed on the recording medium P while the recording medium P on which the toner image T is formed is being conveyed and heated.

The heater 207, provided in a hollow portion of the film 201, is a halogen lamp that emits a radiation beam to heat the sliding plate 213.

A reflecting plate 216 serving as a reflecting member reflects the radiation beam of the heater 207 onto the sliding plate 213 to efficiently heat the sliding plate 213. The reflecting plate 216 extends in a longitudinal direction of the film 201, and has a U-shaped portion having a U-shaped cross section perpendicular to the longitudinal direction of the film 201. Both end portions (both leg portions) of the U-shaped portion of the reflecting plate 216 contact a surface at a side opposite a surface of the sliding plate 213 that contacts the film 201. The heater 207 is provided in a region surrounded by the reflecting plate 216 and the sliding plate 213. The reflecting plate 216 is formed by a high-reflectivity aluminum plate with a mirror-finished surface being bent.

The sliding plate 213 extends along the longitudinal direction of the film 201. The sliding plate 213 has the surface, opposite the side facing the heater 207, coated black to enhance absorption efficiency of radiation energy of the heater 207. Moreover, the sliding plate 213 includes a metal plate having high thermal conductivity such that heat is promptly transferred in a thickness direction from a surface irradiated with the radiation beam to a surface that contacts the film 201. In the present example embodiment, an aluminum plate, with a thickness of 700 μm, subjected to press working is used as the sliding plate 213. The shape of the sliding plate 213 is described below.

The film 201 includes a stainless base layer having a cylindrical shape and a release layer formed on the base layer. The base layer has a thickness of 30 μm, an inner diameter of 30 mm, and a length of 235 mm. The release layer is formed by coating of the base layer with tetrafluoroethylene-perfluoroalkyl vinyl ether copolymer (PFA) resin via an adhesive layer. For the base layer, another metal material, such as nickel, or a heat-resistant resin material, such as polyimide, can be used. Additionally, an elastic layer can be provided between the base layer and the release layer to improve image quality. The film 201 is driven to rotate by rotation of the pressure roller 203. The film 201 is driven to rotate while sliding against the sliding plate 213.

Heat-resistant lubricant is interposed between the two members to reduce sliding friction with the sliding plate 213. Examples of the lubricant include fluorine grease, fluorine oil, and silicone oil.

The pressure roller 203 extends along the longitudinal direction of the film 201, and includes a metal core 217 and an elastic layer 218 outside the metal core 217. According to the present example embodiment, the metal core 217 is made of stainless steel having an outer diameter of 18 mm. Moreover, the elastic layer 218 is made of silicone rubber having a thickness of 3.5 mm. A release layer (not illustrated) made of PFA having a thickness of 50 μm can be provided outside the elastic layer 218. The pressure roller 203 has an outer diameter of approximately 25 mm and a surface hardness of 55 degrees (ASKER Durometer Type C, a load of 1.0 kg).

Both longitudinal end portions of the film 201 and both longitudinal end portions of the sliding plate 213 extend to the outside of both longitudinal end portions of the elastic layer 218 of the pressure roller 203. Such arrangement prevents the elastic layer 218 of the pressure roller 203 from being rubbed against the sliding plate 213. In the present example embodiment, the film 201 has a longitudinal length of 235 mm, whereas the elastic layer 218 of the pressure roller 203 has a longitudinal length of 225 mm. Thus, a non-contact region which does not contact the pressure roller 203 is provided near each of the both end portions of the film 201.

Figure 2:
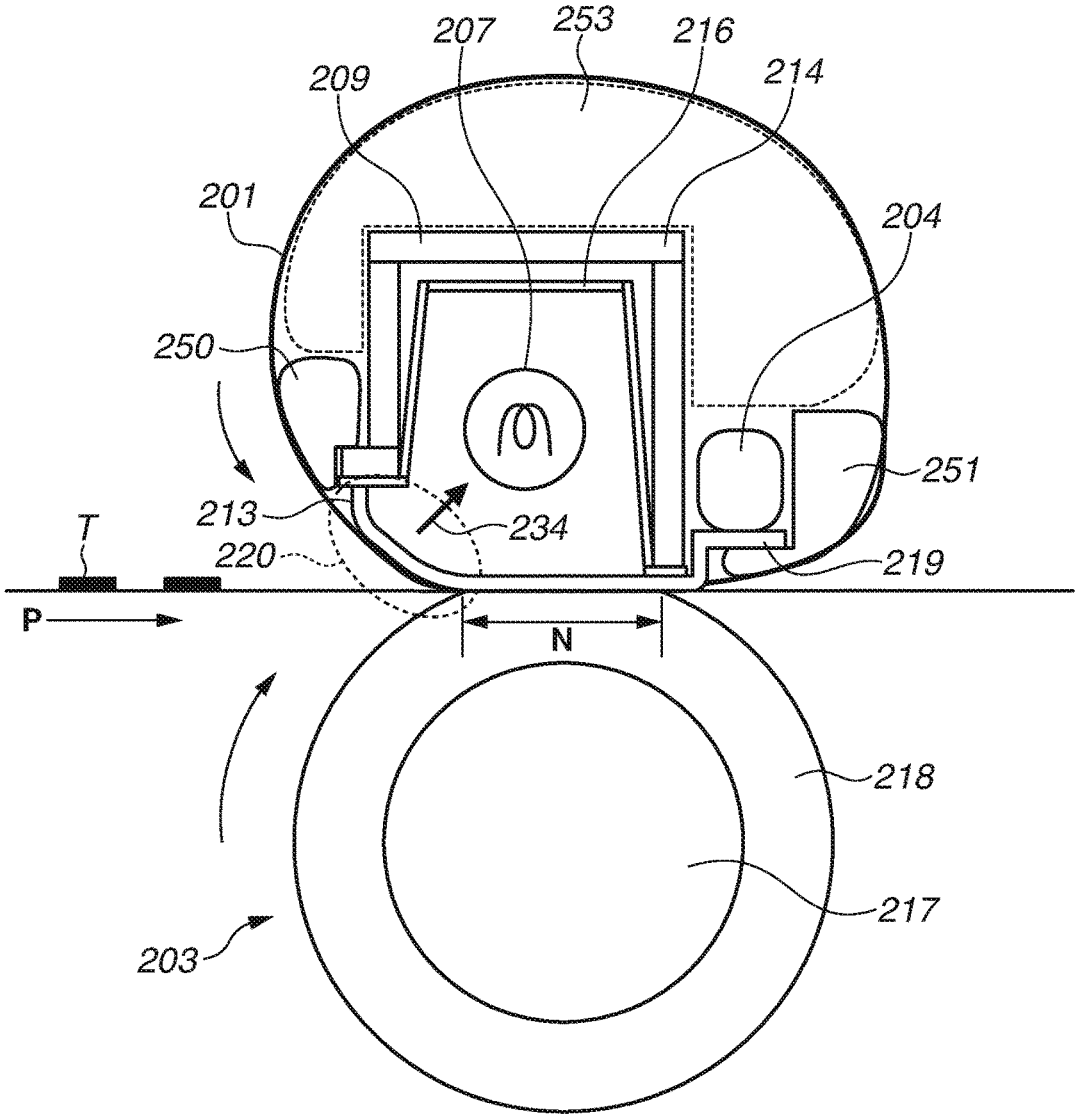
FIG. 2 is a schematic sectional view illustrating a fixing device according to the first example embodiment.

In FIG. 2, guide members 250 and 251 guide movement of the film 201 across the longitudinal direction. The guide members 250 and 251 are respectively provided on an upstream side and a downstream side of the sliding plate 213 in a rotation direction of the film 201.

In FIG. 2, a flange 253 contacts an inner surface of the film 201 in the vicinity of the both longitudinal end portions of the film 201. On an inner surface of the film 201, the flange 253 serves as a member that guides movement of the film 201 in the both longitudinal end portions in which the sliding plate 213 or the guide members 250 and 251 are not provided. Since the flange member is not provided in the longitudinal middle portion illustrated in the sectional view, the flange member is represented by a dotted line in FIG. 2.

In FIG. 2, a stay 214 as a reinforcing member reinforces flexural rigidity of the sliding plate 213. Moreover, the stay 214 transfers pressure received from a pressure mechanism (not illustrated) to the sliding plate 213. As a result, the sliding plate 213 is pushed toward the pressure roller 203 via the film 201, the elastic layer 218 of the pressure roller 203 is deformed, and the nip portion N is formed.

In FIG. 2, a thermistor 204 as a temperature detection member detects the temperature of the sliding plate 213. The sliding plate 213 includes an extension portion 219 extending on a downstream side of the nip portion N in a recording medium conveyance direction. The extension portion 219 contacts the thermistor 204. Electric power to be supplied to the halogen heater 207 is controlled according to a detected temperature of the sliding plate 213 detected by the thermistor 204.

<Shape of Sliding Plate>

A description will now be provided of the shape of the sliding plate 213, which is a characterizing features of the present example embodiment. The sliding plate 213 includes a curvature portion 220 curving along an inner surface of the film 201 on an upstream side of the nip portion N in the recording medium conveyance direction. According to the present example embodiment, in the longitudinal direction of the film 201, an end portion of the curvature portion 220 of the sliding plate 213 has a recessed region recessed in a direction away from the inner surface of the film 201 relative to a middle portion.

Figure 3A:
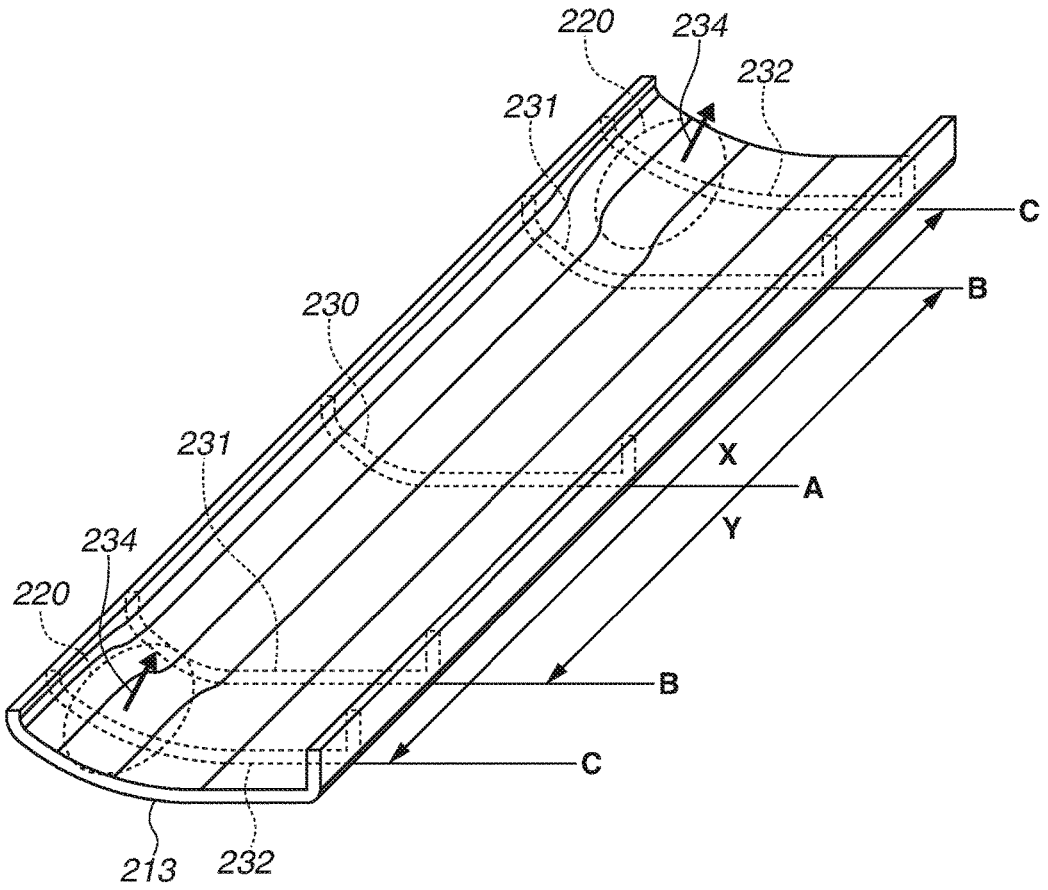
FIGS. 3A and 3B are respectively a perspective view and a schematic diagram illustrating a sliding plate according to the first example embodiment.
Figure 3B:
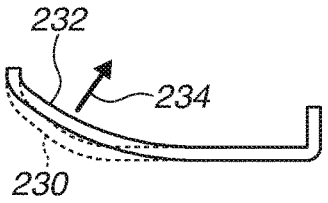

The shape of the sliding plate 213 according to the present example embodiment is described in detail with reference to FIGS. 3A and 3B. FIG. 3A is a perspective view of the sliding plate 213 according to the present example embodiment as seen from a surface side irradiated with a radiation beam of the heater 207. In FIG. 3A, positions A, B, and C respectively indicate positions corresponding to a longitudinal middle portion of the film 201, a longitudinal end portion of the elastic layer 218 of the pressure roller 203, and a longitudinal end portion of the film 201 (hereinafter, the positions A, B, and C in the present example embodiment indicate the respective positions illustrated in FIG. 3A). In FIG. 3A, a length X and a length Y respectively indicate a length in the longitudinal direction of the film 201 and a length in a longitudinal direction of the elastic layer 218 of the pressure roller 203, and a relation X>Y is satisfied. Moreover, in FIG. 3A, sectional shapes 230, 231, and 232 of the sliding plate 213 in the positions A, B, and C, respectively, are illustrated with broken lines. FIG. 3B illustrates a cross section of the sliding plate 213 in the position C.

According to the present example embodiment, a region on an outer side of the position C in the curvature portion 220 of the sliding plate 213 in the longitudinal direction is taken as the recessed region recessed in a direction indicated by an arrow 234 illustrated in FIGS. 3A and 3B, relative to the longitudinal middle portion of the film 201 in the position A. The direction indicated by the arrow 234 represents a direction away from the inner surface of the film 201. The sectional shape of the sliding plate 213 in a region from the position A to the position B is substantially the same as the sectional shape 230 in the position A illustrated in FIG. 3B. The curvature portion 220 of the sliding plate 213 is gradually recessed in the direction away from the inner surface of the film 201 as it approaches the position C from the position B. Then, the curvature portion 220 has the sectional shape 232 in the position C as illustrated in FIG. 3B. The recessed region is formed by a drawing process.

A description will now be provided of an advantageous effect of the sliding plate 213 according to the present example embodiment. Since the longitudinal end portion of the film 201 is provided on the outer side of the longitudinal end portion of the elastic layer 218 of the pressure roller 203, the region between the positions B and C of the film 201 in FIG. 3B is a non-contact region in which the pressure roller 203 does not contact a surface of the film 201. In this non-contact region, the film 201 is not pushed against the sliding plate 213 by the pressure roller 203. Thus, a rotation trajectory on which the outer circumference surface of the film 201 in the non-contact region is rotated is different from a rotation trajectory on which the outer circumference surface of a contact region of the film 201 contacting the pressure roller 203 is rotated.

Figure 4:
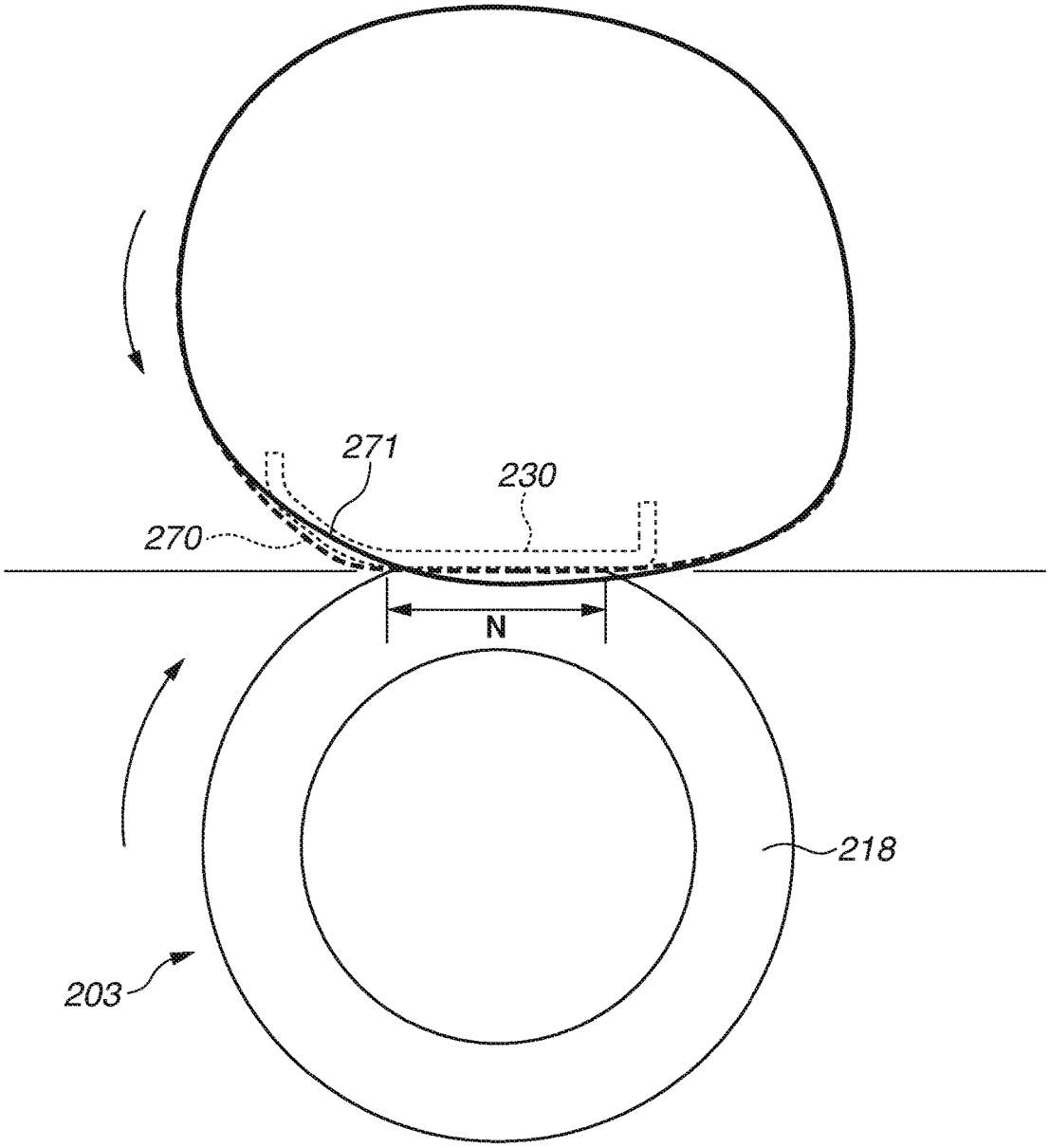
FIG. 4 is a sectional view illustrating a trajectory of a film according to the first example embodiment.

FIG. 4 is a diagram illustrating a comparison between a rotation trajectory 270 (a broken line) of the film 201 in the position A, which is the contact region, and a rotation trajectory 271 (a solid line) of the film 201 in the position C, which is the non-contact region. In FIG. 4, the sectional shape 230 represents the cross section surface of the sliding plate 213 in the position A.

In the nip portion N, the rotation trajectory 270 of the film 201 is pressed against the sliding plate 213 by the pressure roller 203, and follows the sectional shape 230 of the sliding plate 213, whereby the rotation trajectory 270 is retained so as to be in a substantially flat shape. Hence, the rotation trajectory 270 of the film 201 in an upstream region immediately before the nip portion N projects toward an upstream side due to influence of the portion retained in the nip portion N.

On the other hand, the rotation trajectory 271 of the film 201 in the position C is not pressed against the sliding plate 213 by the pressure roller 203. Thus, the film 201 is not retained in the nip portion N. The rotation trajectory 271 of the film 201 becomes a substantially cylindrical shape by rigidity of the film 201, and thus swells toward the pressure roller 203 relative to the position A in the vicinity of the nip portion N. A trajectory of the film 201 in the upstream region immediately before the nip portion N in the position C does not project toward the upstream side of the nip portion N, and thus is retracted in a direction away from the inner surface of the film 201 relative to the trajectory 270 of the film 201 in the position A.

If a sectional shape of the sliding plate 213 in the position C is substantially the same as the sectional shape 230 in the position A, the trajectory of the film 201 in the position C largely interferes with the curvature portion 220 of the sliding plate 213. Consequently, it is conceivable that the film 201 strongly slides against the curvature portion 220 of the sliding plate 213 in the position C.

With such reasons, in the present example embodiment, the recessed region in which the curvature portion 220 of the sliding plate 213 is recessed in the direction away from the inner surface of the film 201 is provided according to the rotation trajectory of the film 201 on the outer side of the end portion of the elastic layer 218 of the pressure roller 203.

The recessed region of the curvature portion 220 of the sliding plate 213 may be provided in a region at least between the position B and the position C in the longitudinal direction of the film 201. A start position of the recessed region of the curvature portion 220 of the sliding plate 213 can be on the inner side of the position B (toward the middle portion), but is desirably outside an image forming region. In this way, an image can be prevented from being affected by a change in shape of the nip portion N or a change in temperature of the film 201 due to a change in a sectional shape of the sliding plate 213 in the recessed region. An end position of the recessed region of the curvature portion 220 of the sliding plate 213 can be on the outer side of the position C.

A recessed amount with respect to the longitudinal middle portion in the recessed region of the curvature portion 220 of the sliding plate 213, and a sectional shape of the curvature portion 220 are not limited to those described in the present example embodiment. In the present example embodiment, a sectional shape of the curvature portion 220 in the position C is determined as below such that contact pressure with respect to the curvature portion 220 of the sliding plate 213 in the longitudinal end portion of the film 201 is weakened.

Figure 5:
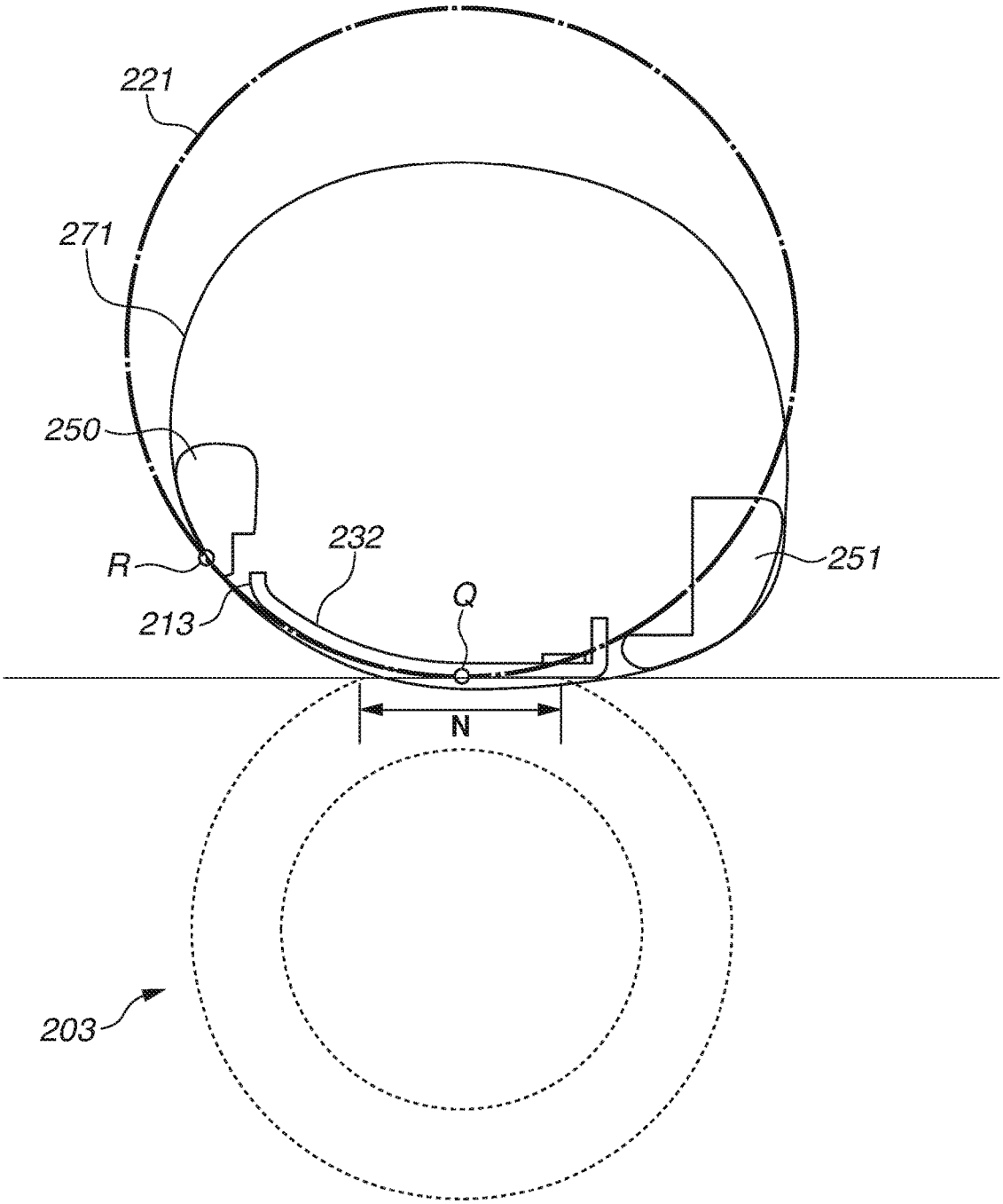
FIG. 5 is a sectional view illustrating a recessed amount of a curvature portion of the sliding plate according to the first example embodiment.

FIG. 5 is a sectional view illustrating the fixing device in the longitudinal middle portion of the film 201. If a virtual point Q is set at the center of the nip portion N in the recording medium conveyance and in an inner surface nip region in which the film 201 contacts the sliding plate 213, a rotation trajectory of the film 201 in the position C enters the side near the pressure roller 203 relative to the virtual point Q. That is, if the rotation trajectory of the film 201 is in a substantially circular shape, it passes the virtual point Q and is provided outside a circle that contacts a side surface of the sliding plate 213 facing an inner surface of the film. Moreover, since rotation of the film 201 is regulated by the guide member 250 on the upstream side, the rotation trajectory of the film 201 in the position C is outside a circle that circumscribes the upstream-side guide member 250 in a circumscribed point R. In consideration of such matters, a virtual circle 221 that not only contacts the inner surface nip region but also circumscribes the guide member 250 in the virtual point Q is provided as illustrated in FIG. 5. In the vicinity of the curvature portion 220 of the sliding plate 213, the rotation trajectory of the film 201 in the position C becomes substantially the same as that of the virtual circle 221 or outside the virtual circle 221. In the present example embodiment, a shape of the curvature portion 220 of the sliding plate 213 in the position C is formed so as to be provided inside the virtual circle 221.

As described in the aforementioned example embodiment, it is conceivable that the present example embodiment can provide an advantageous effect that abrasion of an inner surface near the longitudinal end portion of the film 201 is more reduced than that with a configuration in which a recessed region is not provided in the curvature portion 220 of the sliding plate 213. According to the present example embodiment, therefore, providing of the recessed region in the curvature portion of the sliding plate can provide the advantageous effect of suppressing abrasion of the longitudinal end portion of the film due to slide of the sliding plate against the film.

Figure 6A:
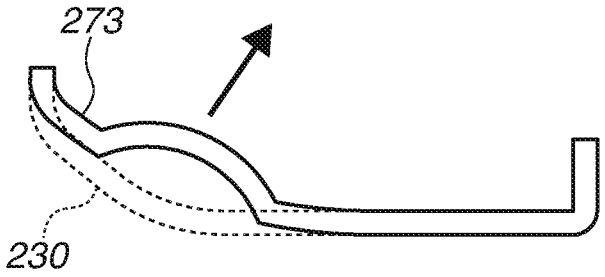
FIGS. 6A and 6B are sectional views each illustrating a sliding plate with another configuration according to the first example embodiment.
Figure 6B:
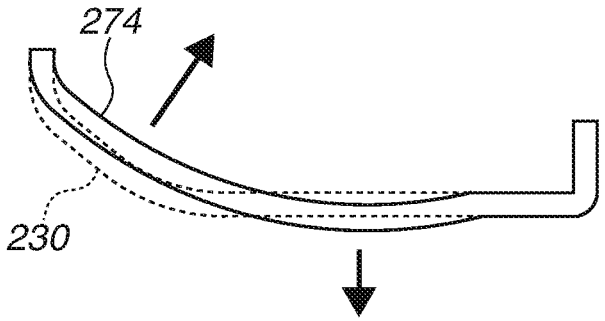

The shape of the recessed region of the curvature portion 220 of the sliding plate 213 is not limited to the configuration described in the present example embodiment. A sectional shape of the curvature portion 220 of the sliding plate 213 in the position C can be a projection shape such that the projection shape projects in a direction indicated by an arrow relative to the position A (a direction away from the inner surface of the film 201), as a sectional shape 273 illustrated FIG. 6A. Moreover, a sectional shape of the sliding plate 213 in the position C can be formed as a sectional shape 274 illustrated in FIG. 6B according to a trajectory of the film 201 swelling toward the pressure roller 203 in the position C. In other words, one portion of the sliding plate 213 can project in a direction indicated by the arrow relative to the position A (a direction approaching the pressure roller 203).

A fixing device according to a second example embodiment will be described with reference to FIG. 7. The present example embodiment is similar to the first example embodiment except for a shape of a sliding plate. Since a configuration other than the shape of the sliding plate is substantially the same as that of the first example embodiment, a description of the similar configuration is omitted.

Figure 7:
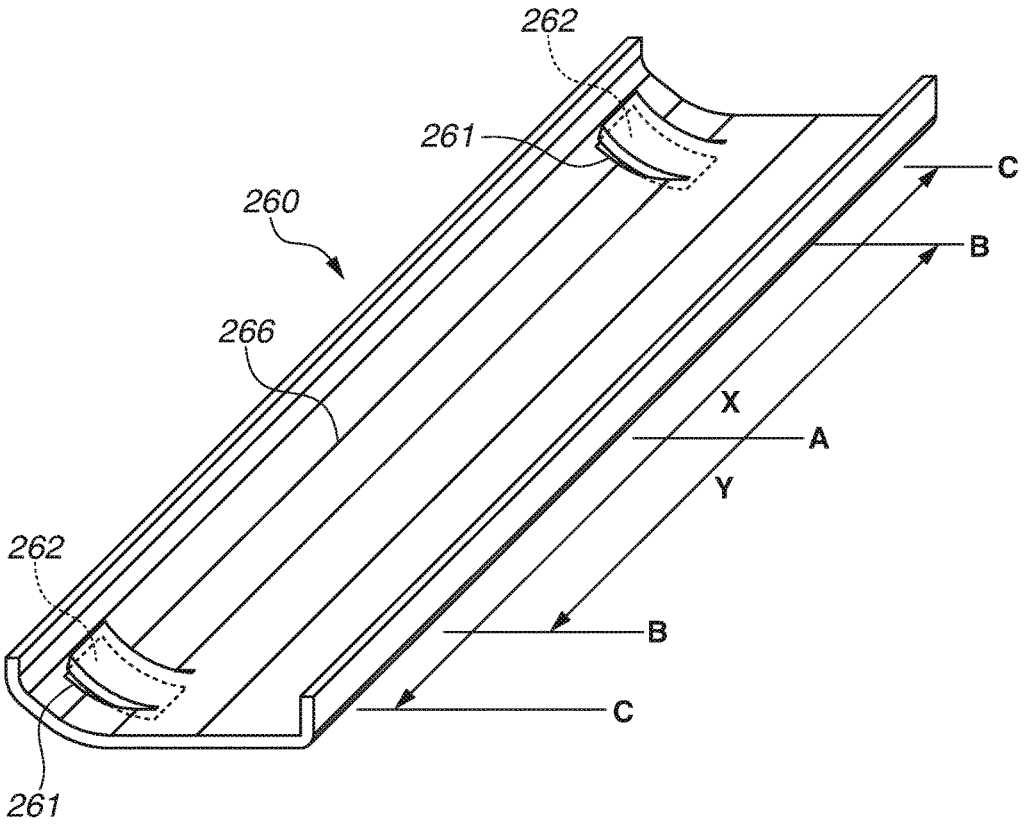
FIG. 7 is a perspective view illustrating a sliding plate according to a second example embodiment.

FIG. 7 is a perspective view illustrating an overall shape of a sliding plate 260 according to the present example embodiment. In FIG. 7, positions A, B, and C respectively indicate positions corresponding to a longitudinal middle portion of a film 201, a longitudinal end portion of an elastic layer 218 of a pressure roller 203, and a longitudinal end portion of the film 201 (hereinafter, the positions A, B, and C in the present example embodiment represent the respective positions illustrated in FIG. 7). In FIG. 7, a length X and a length Y respectively indicate a length in a longitudinal direction of the film 201 and a length in a longitudinal direction of the elastic layer 218 of the pressure roller 203, and a relation X>Y is satisfied.

In the present example embodiment, a U-shaped cut 261 is provided in a region including the position C in the longitudinal end portion of a curvature portion 266 of the sliding plate 260. Then, a portion inside the U-shaped cut 261 is bent and raised toward the side away from an inner surface of the film 201, thereby forming a bent-up portion 262 on the sliding plate 260. The region including the cut 261 is provided on the outer side of the position B so as not to overlap the elastic layer 218 of the pressure roller 203 in the longitudinal direction.

As in the first example embodiment, the present example embodiment provides an advantageous effect of suppressing abrasion of the longitudinal end portion of the film due to slide of the sliding plate against the film with the bent-up region being provided in the curvature portion of the sliding plate.

A fixing device according to a third example embodiment will be described with reference to FIG. 8. The present example embodiment is similar to the first example embodiment except for a shape of a sliding plate. Since a configuration other than the shape of the sliding plate is substantially the same as that of the first example embodiment, a description of the similar configuration is omitted.

Figure 8:
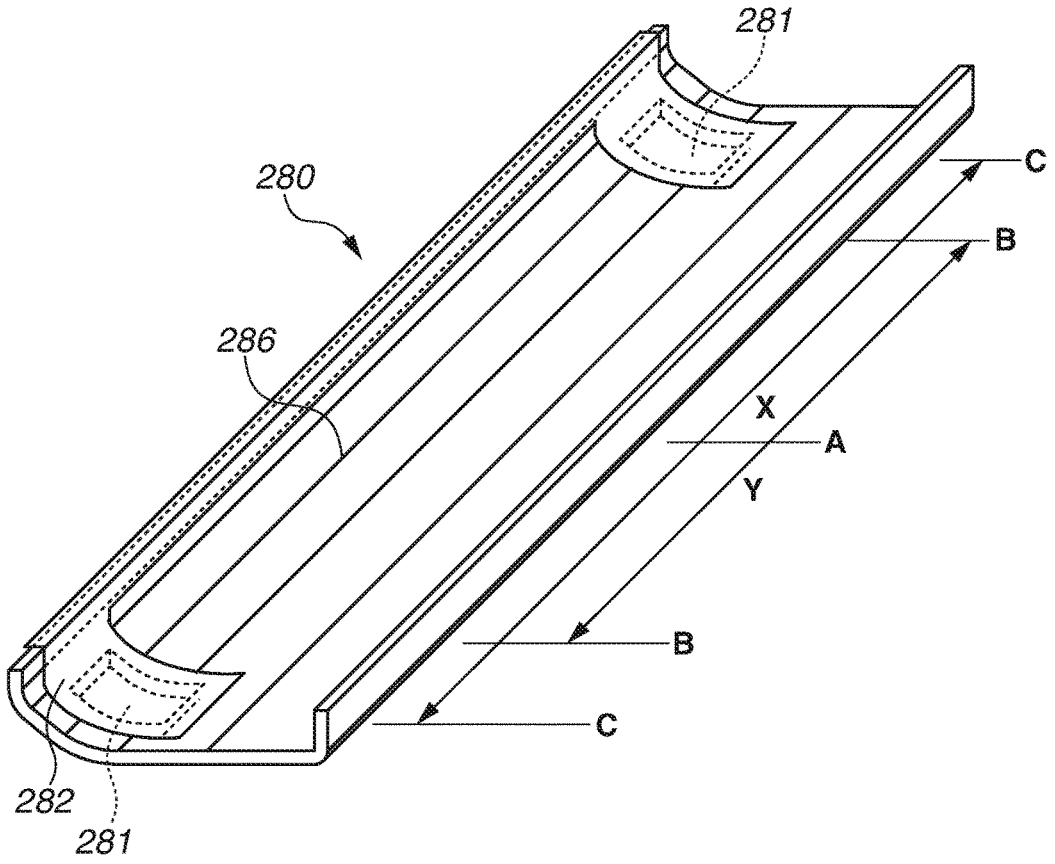
FIG. 8 is a perspective view illustrating a sliding plate according to a third example embodiment.

FIG. 8 is a perspective view illustrating an overall shape of a sliding plate 280 according to the present example embodiment. In FIG. 8, positions A, B, and C respectively indicate positions corresponding to a longitudinal middle portion of a film 201, a longitudinal end portion of an elastic layer 218 of a pressure roller 203, and a longitudinal end portion of the film 201 (hereinafter, the positions A, B, and C in the present example embodiment indicate the respective positions illustrated in FIG. 8). In FIG. 8, a length X and a length Y respectively indicate a length in a longitudinal direction of the film 201 and a length in a longitudinal direction of the elastic layer 218 of the pressure roller 203, and a relation X>Y is satisfied.

In the present example embodiment, an aperture hole 281 is provided in a region including the position C in the longitudinal end portion of a curvature portion 286 of the sliding plate 280, and the film 201 does not contact the sliding plate 280 in such a region.

The region including the aperture hole 281 is provided on the outer side of the position B so as not to overlap the elastic layer 218 of the pressure roller 203 in the longitudinal direction.

A blocking member 282 is provided on a surface of the aperture hole 281 on a side facing a heater 207 such that lubricant on an inner surface of the film 201 is not degraded by being directly heated by the heater 207 via the aperture hole 281. The blocking member 282 is a thin aluminum plate. The blocking member 282 is fixed by being nipped between the sliding plate 280 and a stay 214. The blocking member 282 may not necessarily be provided. In such a case, a reflecting plate 216 may be extended to the aperture hole 281 of the sliding plate 280 to block the aperture hole 281.

As in the first example embodiment, the present example embodiment provides an advantageous effect of suppressing abrasion of the longitudinal end portion of the film due to slide of the sliding plate against the film with the bent-up region being provided in the curvature portion of the sliding plate.

A fixing device according to a fourth example embodiment is described with reference to FIG. 9. The present example embodiment is similar to the first example embodiment except for a shape of a sliding plate. Since a configuration other than the shape of the sliding plate is substantially the same as that of the first example embodiment, a description of the similar configuration is omitted.

Figure 9:
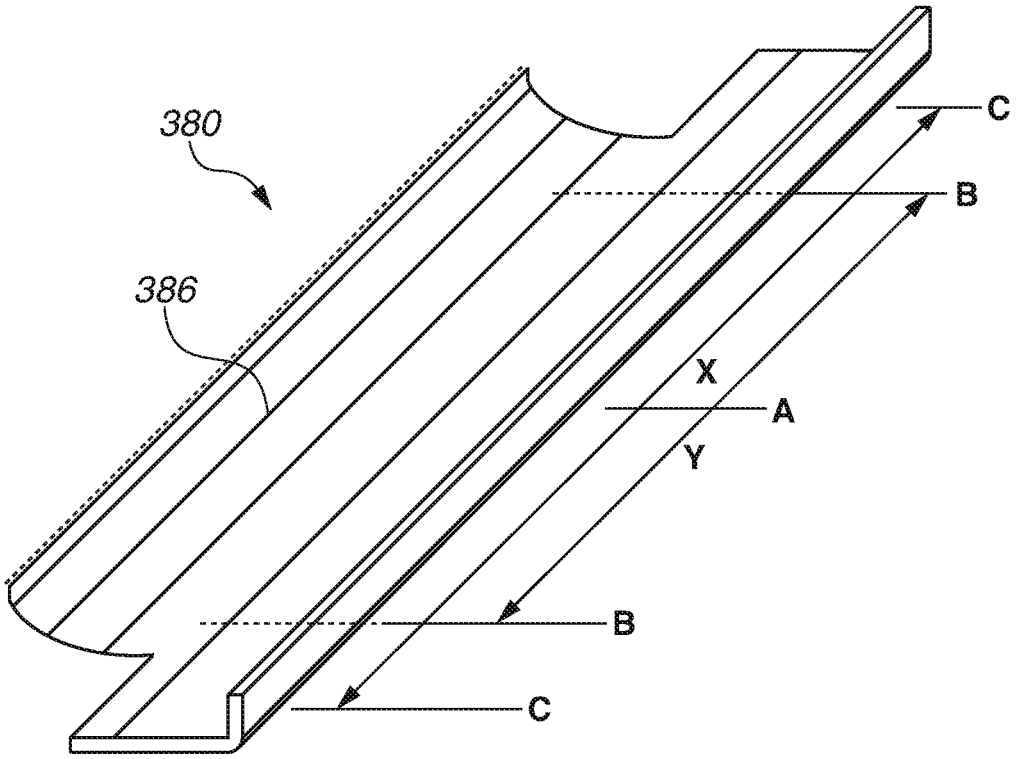
FIG. 9 is a perspective view illustrating a sliding plate according to a fourth example embodiment.

FIG. 9 is a perspective view illustrating an overall shape of a sliding plate 380 of the present example embodiment. In FIG. 9, positions A, B, and C respectively indicate positions corresponding to a longitudinal middle portion of a film 201, a longitudinal end portion of an elastic layer 218 of a pressure roller 203, and a longitudinal end portion of the film 201 (hereinafter, the positions A, B, and C in the present example embodiment indicate the respective positions illustrated in FIG. 9). In FIG. 9, a length X and a length Y respectively indicate a length in a longitudinal direction of the film 201 and a length in a longitudinal direction of the elastic layer 218 of the pressure roller 203, and a relation X>Y is satisfied.

The present example embodiment is characterized in that the sliding plate 380 includes a region in which a curvature portion 386 is not provided between the position B and the position C in the longitudinal direction of the film 201. A boundary between the region including the curvature portion 386 and a region not including the curvature portion 386 is provided in such a manner that the boundary is positioned on the outer side of the position B.

As in the first example embodiment, the present example embodiment provides an advantageous effect of suppressing abrasion of the longitudinal end portion of the film due to slide of the sliding plate against the film in the region in which the curvature portion 386 is not provided.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-148698, filed Jul. 28, 2016, which is hereby incorporated by reference herein in its entirety.

What is claimed is:

1. A fixing device for fixing an image on a recording medium, the fixing device comprising:

a cylindrical film;

a sliding plate, having a generally non-tubular and non-hollow cross-sectional shape, that contacts an inner surface of the film, the sliding plate extending in a longitudinal direction of the film; and a roller that forms a nip portion with the sliding plate via the film, the roller including a metal core and an elastic layer formed outside the metal core, and extending in the longitudinal direction of the film, wherein, in the nip portion, the recording medium on which the image is formed is heated while the recording medium is being conveyed, and the image is fixed on the recording medium, wherein the film and the sliding plate have respective longitudinal end portions positioned on an outer side of a longitudinal end portion of the elastic layer of the roller, wherein the sliding plate includes a curvature portion that is curved along a circumferential direction of an inner surface of the film on an upstream side of the nip portion in a recording medium conveyance direction and extends along a longitudinal direction of the sliding plate, and the curvature portion includes a recessed region in which a longitudinal end portion of the curvature portion is recessed from the inner surface of the film relative to a longitudinal middle portion of the curvature portion, and wherein, in the longitudinal direction of the film, the recessed region is provided in a region of the curvature portion at least on an outer side of a position corresponding to the longitudinal end portion of the elastic layer and on an inner side of a position corresponding to the longitudinal end portion of the film in the curvature portion.

2. The fixing device according to claim 1, wherein the sliding plate includes a metal plate.

3. The fixing device according to claim 1, further comprising a heater, provided in a hollow portion of the film, that heats the sliding plate by emitting a radiation light toward the sliding plate.

4. The fixing device according to claim 3, further comprising a reflecting member that reflects the radiation light of the heater onto the sliding plate, wherein the reflecting member has a U-shaped portion having a U-shaped cross section perpendicular to the longitudinal direction of the film, and two leg portions of the U-shaped portion contact a surface at a side opposite a surface that contacts the film of the sliding plate, and wherein the heater is provided in a region surrounded by the reflecting member and the sliding member.

5. The fixing device according to claim 1, wherein the sliding plate has a generally rectangular shape defined by a pair of opposing longitudinal side edges and a pair of end edges interconnecting the side edges, one of opposing longitudinal edges including a curvature portion from a cross-sectional perspective and the other longitudinal edge having a flat side portion.

6. The fixing device according to claim 1, wherein the recessed region is provided so that the film does not contact the sliding plate at the position corresponding to the longitudinal end portion of the film.

7. The fixing device according to claim 1, wherein the recessed region is formed by a bent portion provided inside a U-shaped cut that is provided in the sliding plate.

8. A fixing device for fixing an image on a recording medium, the fixing device comprising:

a cylindrical film;

a sliding plate, having a generally non-tubular and non-hollow cross-sectional shape, that contacts an inner surface of the film, the sliding plate extending in a longitudinal direction of the film; and a roller that forms a nip portion with the sliding plate via the film, the roller including a metal core and an elastic layer formed outside the metal core, and extending in the longitudinal direction of the film, wherein, in the nip portion, the recording medium on which the image is formed is heated while the recording medium is being conveyed, and the image is fixed on the recording medium, wherein the film and the sliding plate have respective longitudinal end portions positioned on an outer side of a longitudinal end portion of the elastic layer of the roller, wherein the sliding plate includes a curvature portion that is curved along a circumferential direction of an inner surface of the film on an upstream side of the nip portion in a recording medium conveyance direction and extends along a longitudinal direction of the sliding plate, and the curvature portion includes an aperture hole, and wherein, in the longitudinal direction of the film, the aperture hole is provided in a region of the curvature portion at least on an outer side of a position corresponding to the longitudinal end portion of the elastic layer and on an inner side of a position corresponding to the longitudinal end portion of the film in the curvature portion.

9. The fixing device according to claim 8, wherein the sliding plate includes a metal plate.

10. The fixing device according to claim 8, further comprising a heater, provided in a hollow portion of the film, that heats the sliding plate by emitting a radiation light toward the sliding plate.

11. The fixing device according to claim 10, further comprising a reflecting member that reflects the radiation light of the heater onto the sliding plate, wherein the reflecting member has a U-shaped portion having a U-shaped cross section perpendicular to the longitudinal direction of the film, and two leg portions of the U-shaped portion contact a surface at a side opposite a surface that contacts the film of the sliding plate, and wherein the heater is provided in a region surrounded by the reflecting member and the sliding member.

12. The fixing device according to claim 8, wherein the sliding plate has a generally rectangular shape defined by a pair of opposing longitudinal side edges and a pair of end edges interconnecting the side edges, one of opposing longitudinal edges including a curvature portion from a cross-sectional perspective and the other longitudinal edge having a flat side portion.

13. The fixing device according to claim 8, wherein the aperture hole is provided so that the film does not contact the sliding plate at the position corresponding to the longitudinal end portion of the film.

14. The fixing device according to claim 8, further comprising a blocking member configured to block the aperture hole, wherein the blocking member is provided on a surface of the aperture hole on a side opposite from a side being in contact with the film.

15. The fixing device according to claim 14, wherein the blocking member is an aluminum plate.

16. A fixing device for fixing an image on a recording medium, the fixing device comprising:

a cylindrical film;

a sliding plate, having a generally non-tubular and non-hollow cross-sectional shape, that contacts an inner surface of the film, the sliding plate extending in a longitudinal direction of the film; and a roller that forms a nip portion with the sliding plate via the film, the roller including a metal core and an elastic layer formed outside the metal core, and extending in the longitudinal direction of the film, wherein, in the nip portion, the recording medium on which the image is formed is heated while the recording medium is being conveyed, and the image is fixed on the recording medium, wherein the film and the sliding plate have respective longitudinal end portions positioned on an outer side of a longitudinal end portion of the elastic layer of the roller, wherein the sliding plate includes a curvature portion that is curved along a circumferential direction of an inner surface of the film on an upstream side of the nip portion in a recording medium conveyance direction and extends along a longitudinal direction of the sliding plate, and the curvature portion includes a region in which a curvature portion is not provided, and wherein, in the longitudinal direction of the film, the region in which a curvature portion is not provided is provided in a region of the curvature portion at least on an outer side of a position corresponding to the longitudinal end portion of the elastic layer and on an inner side of a position corresponding to the longitudinal end portion of the film in the curvature portion.

17. The fixing device according to claim 16, wherein the sliding plate includes a metal plate.

18. The fixing device according to claim 16, further comprising a heater, provided in a hollow portion of the film, that heats the sliding plate by emitting a radiation light toward the sliding plate.

19. The fixing device according to claim 18, further comprising a reflecting member that reflects the radiation light of the heater onto the sliding plate, wherein the reflecting member has a U-shaped portion having a U-shaped cross section perpendicular to the longitudinal direction of the film, and two leg portions of the U-shaped portion contact a surface at a side opposite a surface that contacts the film of the sliding plate, and wherein the heater is provided in a region surrounded by the reflecting member and the sliding member.

20. The fixing device according to claim 16, wherein the sliding plate has a generally rectangular shape defined by a pair of opposing longitudinal side edges and a pair of end edges interconnecting the side edges, one of opposing longitudinal edges including a curvature portion from a cross-sectional perspective and the other longitudinal edge having a flat side portion.

21. A fixing device for fixing an image on a recording medium, the fixing device comprising:

a cylindrical film;

a sliding plate, having a generally non-tubular and non-hollow cross-sectional shape, that contacts an inner surface of the film, the sliding plate extending in a longitudinal direction of the film; and a roller that forms a nip portion with the sliding plate via the film, the roller including a metal core and an elastic layer formed outside the metal core, and extending in the longitudinal direction of the film, wherein, in the nip portion, the recording medium on which the image is formed is heated while the recording medium is being conveyed, and the image is fixed on the recording medium, wherein the film and the sliding plate have respective longitudinal end portions positioned on an outer side of a longitudinal end portion of the elastic layer of the roller, wherein the sliding plate includes a curvature portion that is curved along a circumferential direction of the film on an upstream side of the nip portion in a recording medium conveyance direction, wherein the curvature portion includes a recessed region provided in an end portion of the curvature portion in the longitudinal direction of the film and in a surface of the curvature portion opposed to the inner surface of the film, wherein the recessed region is recessed toward a direction away from the inner surface of the film relative to a middle portion of the curvature portion in the longitudinal direction of the film, and wherein the recessed region is provided in the curvature portion at least on an outer side of a position corresponding to the longitudinal end portion of the elastic layer in the longitudinal direction of the film.

22. The fixing device according to claim 21, wherein the sliding plate includes a metal plate.

23. The fixing device according to claim 21, further comprising a heater, provided in a hollow portion of the film, that heats the sliding plate by emitting a radiation light toward the sliding plate.

24. The fixing device according to claim 23, further comprising a reflecting member that reflects the radiation light of the heater onto the sliding plate, wherein the reflecting member has a U-shaped portion having a U-shaped cross section perpendicular to the longitudinal direction of the film, and two leg portions of the U-shaped portion contact a surface at a side opposite a surface that contacts the film of the sliding plate, and wherein the heater is provided in a region surrounded by the reflecting member and the sliding member.

25. The fixing device according to claim 21, wherein the sliding plate has a generally rectangular shape defined by a pair of opposing longitudinal side edges and a pair of end edges interconnecting the side edges, one of opposing longitudinal edges including a curvature portion from a cross-sectional perspective and the other longitudinal edge having a flat side portion.

26. The fixing device according to claim 21, wherein the recessed region is provided so that the film does not contact the sliding plate at the position corresponding to the longitudinal end portion of the film.

27. The fixing device according to claim 21, wherein the recessed region is formed by a bent portion provided inside a U-shaped cut that is provided in the sliding plate.

* * * * *